United States Patent [19]

Fletcher

[11] 4,014,605

[45] Mar. 29, 1977

[54] TRANSFER SYSTEM WITH TAILORED ILLUMINATION

[75] Inventor: Gerald M. Fletcher, Pittsford, N.Y.

[73] Assignee: Xerox Corporation, Stamford, Conn.

[22] Filed: Aug. 20, 1974

[21] Appl. No.: 498,900

Related U.S. Application Data

[63] Continuation-in-part of Ser. No. 421,179, Dec. 3, 1973, Pat. No. 3,846,020.

[52] U.S. Cl. ..... 355/3 R; 96/1.4; 226/94; 271/DIG. 3

[51] Int. Cl.[2] ..... G03G 15/00

[58] Field of Search ..... 355/3 R, 17; 96/1.4; 226/94; 271/DIG. 3

[56] References Cited

UNITED STATES PATENTS

| | | | |
|---|---|---|---|
| 3,414,409 | 12/1968 | Gallo | 96/1.4 |
| 3,642,362 | 2/1972 | Mueller | 355/3 R |
| 3,707,138 | 12/1972 | Cartwright | 96/1.4 X |

*Primary Examiner*—Robert P. Greiner

[57] ABSTRACT

In an electrostatographic copying system wherein a toner image is transferred from an original image support surface to a copy surface by an electrically biased transfer member generating a transfer field, the transfer field is tailored by providing a photoconductive layer in the transfer area, which layer is illuminated, to render it conductive, in the nip and post-nip areas, but not in the pre-nip area. Belt transfer systems are disclosed utilizing this arrangement. Also disclosed is a copy sheet tacking station having a charging device and a source of illuminaton which are simultaneously activated to tack a copy sheet to the belt.

17 Claims, 4 Drawing Figures

TRANSFER SYSTEM WITH TAILORED ILLUMINATION

This is a continuation in part of an allowed copending parent application Ser. No. 421,179, filed Dec. 3, 1973, issued as U.S. Pat. No. 3,846,020 on Nov. 5, 1974. This parent application and the references cited therein are hereby incoporated by reference as part of these specification.

The present invention relates to a developed image transfer system for electrostatographic copiers utilizing selective exposure of a photoconductive transfer member.

In a conventional transfer station in xerography, a developed image of toner particles (from the image developer material) is tranferred from a photoreceptor (the imaging surface) to a cut or roll fed copy sheet (the final image support surface), either directly or after an intermediate image transfer to an intermediate surface. Such image transfers are also required in other electrostatographic processing systems, such as electrophoretic development. In TESI systems the intermediately transferred image may be an undeveloped latent electrostatic image on a non-photoconductive insulator.

Transfer is most commonly achieved by applying electrostatic force fields in a transfer nip sufficient to overcome the forces holding the toner to its original support surface and to attract most of the toner to transfer over onto the contacting second surface. These transfer fields are generally provided in one of two ways, by ion emission from a transfer corona generator onto the back of the copy sheet, as in U.S. Pat. No. 2,807,233, or by a D.C. biased transfer roller or belt rolling along the back of the copy sheet. Examples of bias roller transfer systems are described in U.S. Pat. No. 3,781,105, issued Dec. 25, 1973, to Thomas Meagher, U.S. Class 355/3, Int. Class G03g 15/16, and in U.S. Pat. Nos. 2,807,233; 3,043,684; 3,267,840; 3,328,193; 3,598,580; 3,625,146; 3,630,591; 3,684,364; 3,691,993; and 3,702,482, by C. Dolcimascolo et al., issued Nov. 7, 1972.

The difficulties of successful image transfer are well known. In the pre-transfer (pre-nip) region, before the copy paper contacts the image, if the tranfer fields are high the image is susceptible to premature transfer across the air gap, leading to decreased resolution or fuzzy images. Further, if there is ionization in the pre-nip air gap from high fields, it may lead to strobing or other image defects, loss of transfer efficiency, and a lower latitude of system operating parameters. Yet, in the directly adjacent nip region itself the transfer field should be large as possible (greater than approximately 20 volts per micron) to achieve high transfer efficiency and stable transfer. In the next adjacent post-nip region, at the photoconductor/copy sheet separation (stripping) area, if the transfer fields are too low hollow characters may be generated. On the other hand, improper ionization in the post-nip region may cause image instability or copy sheet detacking problems. Thus, non-symmetrical (tailored) transfer fields are desirable. Variations in ambient conditions, copy paper, contaminants, etc., can all affect the necessary transfer parameters. Bias transfer roll material resistivity and paper resistivity can change greatly with humidity, etc. Further, conduction of the bias charge from the bias roller is also greatly affected by the presence or absence of the copy paper between it and the imaging surface. To achieve these different transfer field parameters consistently, and with appropriate transitions, is difficult. The present invention is directed to overcoming the above and other problems by providing tailored transfer fields with a tailored illumination of photoconductive material.

The transfer system of the invention may be utilized in any desired configuration. It may be utilized for transfer from an imaging surface of any desired configuration, such as a cylinder or a belt. Belt imaging surface photoconductors in electrographic copying systems are exemplified by U.S. Pat. Nos. 3,093,039, 3,697,285, 3,707,138, 3,713,821, and 3,719,165.

Further objects, features and advantages of the present invention pertain to the particular apparatus, steps and details whereby the above-mentioned aspects of the invention are attained. Accordingly, the invention will be better understood by reference to the following description and to the drawing forming a part thereof, wherein.

Figure 1:
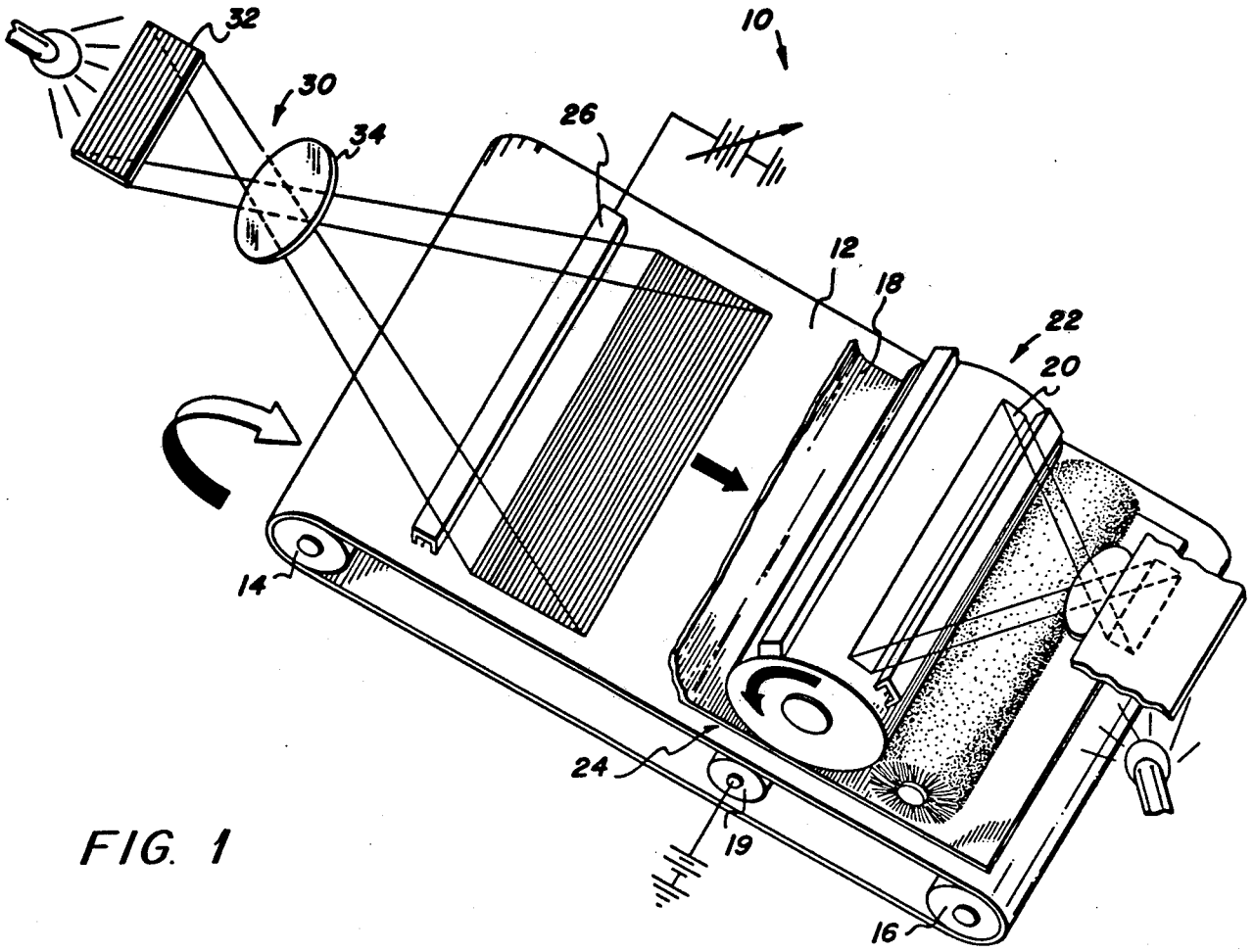
FIG. 1 is a schematic perspective view of an exemplary sheet transport system in accordance with the present invention, including a conventional xerographic copying system.
Figure 2:
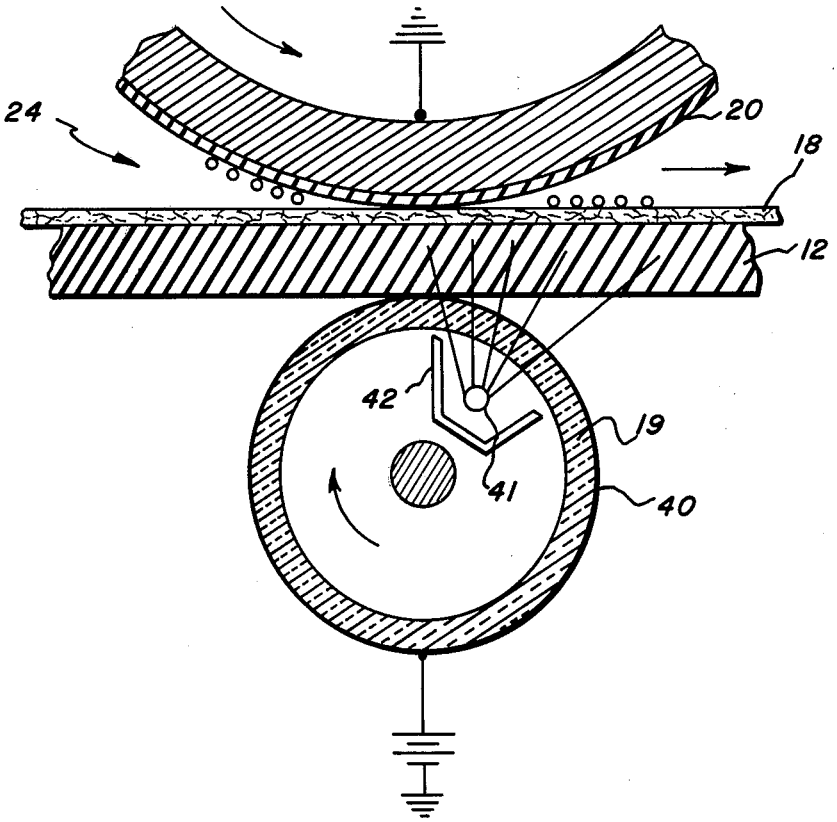
FIG. 2 is an enlarged axial cross-sectional detail of the transfer station of the embodiment of FIG. 1.
Figure 3:
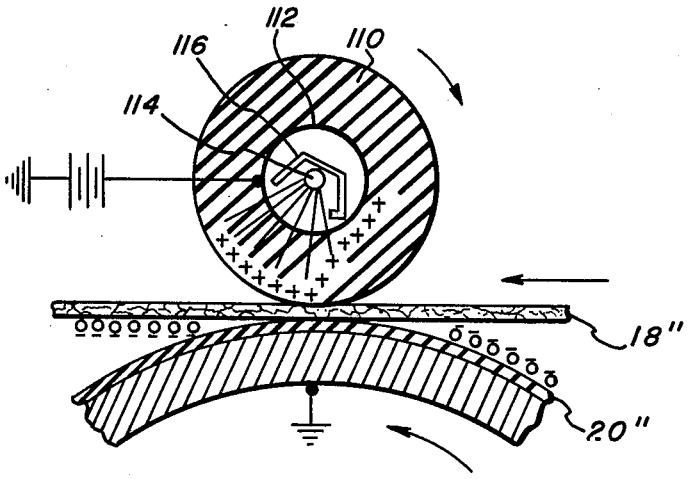
Figure 4:
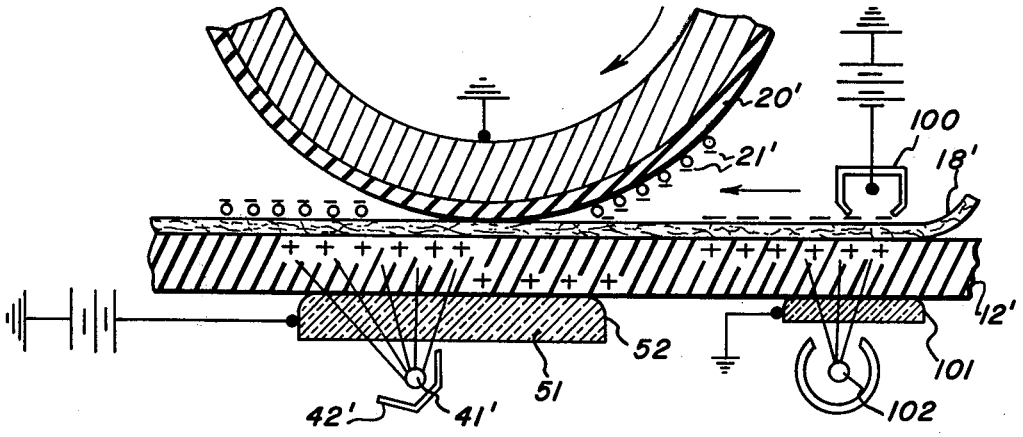

FIG. 3 is a view similar to FIG. 2, but of a different embodiment in which a transfer cylinder with an illuminated photoconductive layer overlies a conventional photoreceptor; and FIG. 4 is a view similar to FIG. 2 of a preferred embodiment utilizing single fixed transparent transfer bias electrode engaging the backside of a photoconductive transfer belt as shown in FIG. 1 in lieu of the transfer roller there.

Referring to FIG. 1, there is schematically shown a sheet transport system 10 described in the parent application. Since various details thereof are well known and fully described in the above-incorporated and other references relating to copy sheet handling, transfer and xerography, these details, for improved clarity, will not be described herein. The present invention is not limited to incorporation in such a system 10, although such incorporation is disclosed.

The system 10 of FIG. 1 comprises a copy sheet transport belt 12 which is supported and rotatably driven between rollers 14 and 16. The transport belt 12, unlike conventional sheet transport belts, is photoconductive. It may be constructed of known photoconductive materials and structures for xerographic photoconductive belts or the like, such as those cited above, either organic or inorganic.

The photoconductive transport belt 12 of FIG. 1 positively supports and carries the copy sheet 18 into and out of contact with an imaging surface 20 of a xerographic copying system 22 at a transfer station 24. Transfer is provided at the transfer station 24 by a bias transfer roller, here comprising an illuminated roller 19 in accordance with the present invention, as will be later described herein. The xerographic copying system 22 shown here also includes the conventional stations for optical imaging, cleaning, charging, and development of the imaging surface 20.

The exemplary transport belt 12, by the electrostatic fringe field charge pattern described immediately below, or other electrostatic sheet tacking systems, provides positive retention of the copy sheet 18 at all desired points along the path of the transport belt 12, until it is desired to strip the copy sheet therefrom by any suitable conventional sheet stripping means. The copy sheet 18 can be positively electrostatically retained through the entire transfer station 24 without affecting the normal xerographic transfer in any way.

To provide the copy sheet retaining charge pattern on the FIG. 1 transport belt 12 as disclosed in the parent application, the belt (which may be previously conventionally neutralized or grounded electrically or optically) is first uniformly conventionally corona charged by a non-contacting conventional corona charging device 26 extending laterally across the width of the transport belt 12, i.e., transversely of the direction of motion of the belt. Subsequent to this electrical charging of the copy sheet supporting surface of the transport belt 12, optical means are provided for selectively optically discharging discrete, but closely adjacent, areas of the transport belt surface across the belt, at a belt discharging station 30.

The disclosed discharging station 30 includes an optical system for optically imaging a fine light pattern of closely alternating adjacent light and dark areas on the copy sheet supporting surface of the belt, so as to photoconductively discharge this supporting surface into a fine charge pattern of alternating closely adjacent charged and discharged areas which will provide copy sheet retaining electrical fringe fields, but these fringe fields do not affect the transfer fields significantly and thus do not affect transfer. This may be provided as shown by sequentially flash imaging on the belt 12, as it advances, an original image pattern 32 of alternating closely adjacent light and dark areas of only approximately 0.13 millimeters spacing between areas, through a conventional imaging lens 34 onto the supporting surface. As previously noted, the present invention is not limited to this system of retaining the copy sheet on the transport belt. The following U.S. patents are exemplary of other systems for electrostatic tacking of paper to a paper transport belt by uniform or non-uniform electrostatic charging of the belt or paper: U.S. Pat. Nos. 2,576,882 to P. Koole et al., 3,357,325 to R. H. Eichorn, 3,642,362 to D. Mueller, 3,690,646 to J. A. Kolivis, 3,717,801 to M. Silverberg, and 3,765,957 to J. Weigl.

It will be appreciated that illumination (light utilized herein for various applications may be either visible or invisible radiant energy, depending on the radiant energy sensitivity of the photoconductive material. In fact, infrared radiation content may be preferable for deeper penetration and generation of charge carriers in the photoconductor.

Referring now to the details of the present invention, as stated in the parent application, an important advantage in using a photoconductive transfer belt is that the transfer fields can be tailored, even for a single potential transfer electrode, by using light sources shinging light into selected regions in and past the transfer nip. This will reduce the belt resistivity in these regions, which can make the pre-nip fields smaller than the nip or post-nip fields if a thick photoconductive belt is used. This is basically a different way of making an electrically "relaxable" belt material, but with a less critical resistivity specification. The requirement is a dark relaxation time for charge flow near the transfer nip much longer than the time spent near the nip. The minimum corresponding dark resistivity of the photoconductor to ensure this depends on process speed, belt thickness, and system geometry, but is typically near $10^{11}$ ohm-cm. The light resistivity must be such that the relaxation time for charge flow in the nip is less than the nip time (typically $10^8$ ohm-cm) but dependent on process speed, belt thickness, and geometry.

In all of the embodiments disclosed herein, tailored (unsymmetrical) transfer fields are provided in a moving transfer system for transferring a previously developed toner image (without requiring segmented or multiple transfer electrodes) by selective exposure of a thick photoconductive dielectric layer only in the transfer nip and post-nip areas.

In the disclosed embodiments of FIGS. 1–2 and 4, a relatively thick photoconductive copy transport belt carries the copy sheets through an otherwise conventional xerographic transfer station. A partially shielded light source is located under the backside of the belt (opposite the copy sheet carrying side). It radiates the photoconductive belt layer in the nip and post-nip areas, but not in the pre-nip area. Transfer fields are conventionally applied by applying a D.C. bias between two conductors (substrates, electrodes or bias rolls) on opposite sides of the transfer nip. The thick photoconductive layer of the belt lies between these two conductors, electrically connecting with one of them. The selective radiation makes the photoconductive layer conductive only in the nip and post-nip areas. This, therefore, applies the electrical bias voltage across a relatively much smaller transfer gap distance in these radiated areas. That is, the effective dielectric thickness is reduced in the nip and post-nip areas, since there the bias charge conducts through the photoconductive layer to the inside surface of the belt. This causes the transfer field intensity (volts per micron) to be much higher in the nip and post-nip areas than in the pre-nip areas, i.e., desirably tailored, even though the same transfer bias voltage is being applied to all areas. Improved electrostatic belt paper tacking systems can be provided by this belt discharge also.

As previously noted, the photoconductive belt here preferably has a dark resistivity of approximately $10^{11}$ ohm-cm or greater, and an illuminated resistivity low enough that the relaxation time for the above-described charge flow through the belt thickness in the nip is faster than the time period in which the belt is in the nip. This is approximately $10^8$ ohm-cm or less, dependent upon process speed and belt thickness. The photoconductive material is preferably one which will provide uniform conduction through its entire thickness layer under illumination, either by transmitting light therein or by providing sufficient charge carriers for the entire layer from surface illumination. As previously noted, infra-red radiation may be utilized.

Several U.S. patents have been noted relating to transfer systems incoporating illumination. Citations and brief descriptions are provided hereinbelow. These and the other references cited herein are incorporated by reference where appropriate.

U.S. Pat. No. 3,414,409 — C. F. Gallo (Xerox) issued Dec. 3, 1968, filed Apr. 30, 1965. This patent teaches xerographic transfer of a conventionally developed toner image by uniformly illuminating the back of a transparent photoconductive imaging surface (a xerographic plate) or, alternatively, by illuminating the image bearing side of the plate (column 3, lines 39–48) through a sufficiently translucent transfer member [copy sheet]. It is also noted that the particulate imaging material could comprise radiation transmitting material. Only a flat plate stationary transfer system is described, so there is no pre and post-nip area or condition, and the entire plate is illuminated. It is stated that this transfer may be accomplished with elimination of any electrostatic transfer field, i.e., with only the illumination discharge of the plate.

U.S. Pat. No. 3,734,724 — William C. York (Eastman Kodak) issued May 22, 1973, filed Oct. 13, 1969 (no drawing). An electrostatic latent image is conventionally formed and toner developed on a transparent electrophotographic element. A receiver member (a lithograph metal or paper master) is initially (pre-transfer) charged with the same polarity as the toner charge to prevent premature toner transfer. This receiver member is then placed in face-to-face contact with the image bearing electrophotographic element, and then a different charge is applied for transfer (a relatively low potential of about 400–600 volts and a polarity opposite that of the toner) while the whole transparent electrophotographic element is flooded with a photorelease exposure through the support [rear] side so as to discharge the electrostatic latent image forces holding the developed image in place.

U.S. Pat. No. 3,707,138 — R. V. Cartwright (Eastman Kodak) issued Dec. 26, 1972, filed Dec. 14, 1970. Here a photoreceptor imaging belt is flooded with light from the rear through a transparent conductive roller support "prior to [abstract, line 9; Col. 4, line 45; and the lamp/reflector configuration in the drawings] and/or during the transfer." Before that, a corona pretransfer charge is applied to the imaging surface as in the reference immediately above. A conventional conductive biased transfer roller forms a transfer nip with the photoreceptor and applies a transfer field to the illuminated nip.

U.S. Pat. No. 3,384,565 — V. Tulagin and L. Carreira (Xerox), issued May 21, 1968, filed July 23, 1964, and its C.I.P., U.S. Pat. No. 3,655,370, issued Apr. 11, 1972. "A photoelectrophoretic imaging system . . . in which the formed image is electrostatically transferred. The transfer is aided by using uniform or imagewise light radiation of the image during transfer." [abstract of U.S. Pat. No. 3,655,370]. The imaging surface is on a flat plate.

U.S. Pat. No. 3,684,362 — J. Weigl (Xerox), issued Aug. 15, 1972, filed Jan. 2, 1970. ". . . An apparatus which subjects an imaging member simultaneously to an electric field and electromagnetic radiation . . . " A transparent cylinder, with a transparent conductive (and high voltage biased) coating and then a transparent insulative coating, contains a lamp or bulb and a reflective shield directing the radiation to what appears in the Figures to be only the nip area of the cylinder. The nip is with a manifold imaging member. Alternative possible applications are noted as a photoelectrophoretic electrode, or, as incidentally noted, in xerography, particularly induction xerography, for the charging/exposing member. Application as a bias transfer roller in xerography is not disclosed.

U.S. Pat. No. 3,684,364 — F. Schmidlin (Xerox) issued Aug. 15, 1972, filed June 24, 1971. A segmented conductor charging roll is disclosed for applying different potentials at different areas on the charging roll relative the contacting photoreceptor, for photoreceptor induction charging (or providing a developing electrode in a photoelectrophoretic process). Simultaneous illumination of the entire area from either the back of the photoreceptor or the inside of the roll is disclosed. Use at a transfer station is not disclosed and a separate transfer station is illustrated.

U.S. Pat. No. 3,146,688 and its divisional No. 3,223,548 — H. Clark et al. (Xerox), issued Sept. 1, 1964, and Dec. 14, 1965, respectively, original filed May 1, 1961. Simultaneous charging and image exposure is disclosed (through a corona screen) but the disclosed transfer is conventional.

U.S. Pat. No. 3,721,551 — C. Cantarano (unassigned) issued Mar. 20, 1973, filed Dec. 8, 1969, as a CIP of an application filed Apr. 18, 1967. Column 2, lines 4–16 states:

> "...an electrographic powder image is developed on a photoconductive layer acting as the original or the image carrier of the above mentioned method; thereafter, a sheet of copy material is placed against this electrographic image, the photoconductive layer is excited by a uniform exposure to a light of high intensity, and an electric field is generated to electrically charge the powder from the excited photoconductive layer; whereby, under the combined action of the electric field and of the light, the charged powder image is transferred on to the sheet of copy material."

U.S. Pat. No. 3,103,445 — H. Bogdonoff et al. (Xerox), issued Sept. 10, 1963, filed May 7, 1959, illustrates a pre-transfer lamp for discharging non-image areas of the photoreceptor prior to conventional corona transfer in xerography. [Pre-transfer illumination plus pre-transfer d.c. biased a.c. corona discharge is in commercial use].

U.S. Pat. Nos. 2,968,552 and 2,968,553 — R. Gundlach (Xerox) both issued Jan. 17, 1961; '553 filed Mar. 3, 1958, as a CIP of U.S. Pat. No. 2,968,552, filed Oct. 1, 1956. A xerographic system is disclosed in which a photoconductor is uniformly charged and a [uniform] layer of toner is applied. Image transfer (of selected portions of this toner layer) to the copy sheet is then accomplished by rear imagewise exposure of the photoreceptor during transfer, together with a high reverse transfer field where reversed image transfer is desired.

U.S. Pat. No. 3,595,771 — J. Weigl (Xerox). Removal of undesired surface charges on the outer surface of a photoelectrophoretic blocking electrode roller is taught by the roller having a photoconductive outer layer which is discharged by illumination after the image development nip.

None of the above references teach flooding illumination of xerographic transfer nip and post-nip areas while shielding from illumination the pre-nip area to tailor the transfer fields. They do not teach transfer field controlling illumination of a photoconductive belt which is the copy carrier and not the imaging surface (which belt forms a transfer nip with a curved imaging surface area for transfer of a developed toner image therefrom). They do not teach that the selectively illuminated thick photoconductive layer can, in an embodiment like FIG. 3 here, be a layer on a bias transfer roll engaging the original imaging surface rather than a belt.

Referring now specifically to FIG. 2, the transfer station 24 of FIG. 1 is illustrated there in enlarged detail. (FIG. 1 itself is identical to the figure of the parent application). The FIG. 2 view is a cross-section in a plane extending along the direction of motion of the photoconductive transport belt 12 and the copy sheet 18 transported thereon, and perpendicular thereto. There is a conventional transfer nip area formed here between the conventional photoconductive imaging surface 20 of the xerographic drum on its grounded conductive substrate, on the one hand, and the bias transfer roller 19 on the other hand. The belt 12 and the copy sheet 18 pass through the nip between the two, moving into and out of engagement with the imaging surface 20. The toner or other image on the imaging surface 20 is transferred to the copy sheet 18 in the transfer nip. The curvature of the imaging surface 20 relative to the copy sheet holding belt 12 defines a pre-nip air gap and a post-nip gap on the upstream and downstream sides, respectively, of the central transfer nip area.

The electrostatic image transfer here is accomplished by applying an electrical transfer field across the space between the biased surface of the transfer member 19 and the conductive substrate of the imaging surface 20 through which both the belt 12 and copy sheet 18 pass. This is accomplished here by applying a single transfer bias potential to the single, unsegmented, transfer roller 19. The roller 19 here comprises a NESA glass or other light conducting cylinder which is overcoated with a transparent but conductive layer 40. A conventional transfer bias voltage supply is connected to the conductive layer 40. Thus, the entire bias roller 19 is provided with a single transfer voltage, and this bias potential is applied against the backside of the transport belt 12, and acts through it. If the transport belt 12 were a simple uniformly dielectric or conductive member, this would cause a symmetrical transfer field, with substantially equal pre-nip and post-nip transfer field conditions.

It may be seen that there is provided here inside the transfer roller 19, a conventional lamp or other light source 41 partially surrounded by a light shield 42. The lamp 41 shines its light, only within the confines allowed by the light shield 42, through the wall of the bias roller 19 and into a selected strip across the photoconductive belt 12 from the rear side thereof. The lamp 41 and its reflector 42 are stationary, although the roller 19 is free to rotate so as to roll against the back of the belt 12. Since the axis of the drum carrying the imaging surface 20 is also fixed, the lamp 41 continuously illuminates the same areas of the transfer region, specifically the transfer nip area itself and the post-nip air gap region. It may be seen, however, that the shield 42 blocks and prevents any significant illumination from the lamp 41 from extending appreciably into the belt 12 in advance of the actual transfer contact or nip area. That is, the shield 42 blocks light from exposing the belt 12 and rendering it conductive in the pre-nip air gap region.

The above discussed structure of FIG. 2 accomplishes the objective of rendering the photoconductive belt conductive in the nip and post-nip areas, but non-conductive (insulative) in the pre-nip area of the transfer station. Due to the thickness of the photoconductive belt 12, this means that in the pre-nip air gap the belt 12 is acting as a thick dielectric layer separating the transfer bias charges on the transfer roller 19 from the conductive substrate of the imaging surface 20 by a sufficiently great distance such that the field intensity produced by these biasing charges is relatively weak and incapable of prematurely transferring toner from the imaging surface 20. In contrast, within the transfer nip and post-nip regions, the photoconductive belt is rendered conductive by its illumination there. Thus, it ceases to act as a dielectric barrier in these regions and transfer charges are conducted therein up to adjacent the interface of the belt 12 with the copy sheet 18. This places these transfer charges much closer to the conductive substrate of the imaging surface 20 in these areas and, therefore, provides a much higher field intensity from the same bias potential applied to the biased roller 19 in these areas than in the pre-nip area.

The differences in effective transfer field intensity between the conductive and non-conductive areas of the photoconductor belt 12 are a function of the thickness of this photoconductor belt relative to the thickness of the copy paper plus other transfer gaps. It is preferable that the transfer electrode, in this case the bias roll 19, be in direct continuous contact with the back of the belt 12 at the transfer nip so as to prevent any disruptive air gaps therebetween. The imaging surface 20 is quite thin. Thus, the transfer gap here is effectively determined by the thickness of the copy sheet 18 and the belt 12. To provide significant transfer field tailoring the effective thickness of the belt 12 should be substantially thicker than that of the copy sheet 18. Thus, it is desirable that it be greater than approximately 5 mills in thickness, and as thick as practicable. The effective thickness of the belt 12 is the difference between its effective dielectric thickness under dark (non-illuminated) conditions versus under illuminated conditions. Both the transfer roller 19 and the belt 12 may, of course, have dielectric protective overcoatings or layers which would not be affected by illumination. They, however, should preferably be relatively thin in comparison to the effective photoconductive thickness of the belt 12. Also, direct contact charging of the belt 12 by the bias roller 19 is preferred although non-contact charge induction in the conductive (illuminated) regions of the belt 12 could also be utilized.

It will be noted that the illumination of the belt 12 from the lamp 41 is allowed by the shield 42 to continue substantially into the post-nip region, i.e., for some distance after the bias roller 19 and the imaging surface 20 have moved apart by a distance such that there is no significant transfer field intensity, and such that the belt 12 has also moved substantially away from the imaging surface 20. This continued illumination after the removal of the transfer field and the image bearing copy sheet allows the neutralization of charges within the photoconductive belt.

The photoconductor copy supporting belt 12 is not an imaging surface and is subjected only to flooding illumination, not imaging. Thus, an imaging quality photoconductive material is not required. Inexpensive and relatively optically insensitive (low efficiency) photoconductive materials can be utilized for this belt. For example, various known photoconductor webs may be used in which organic or inorganic photoconductive particles are held by an organic translucent binder material providing the desired physical properties for the belt. The thickness and dielectric constant of the belt should be quite uniform, however.

Unlike the referenced prior art electrically relaxable bias transfer members that depend on a relatively constant high resistivity and constant nip transit time in order to maintain properly tailored transfer fields, the present arrangement is not humidity or temperature sensitive. The relaxation of charge through the belt here is positively turned on and off by the presence or absence of the belt illumination, and is, therefore, quite uncritical of resistivity changes or variations within the broad ranges indicated previously, and is not affected by minor belt speed changes.

Referring now to the embodiment of FIG. 4, it may be seen that this embodiment is basically similar to that of FIGS. 1 and 2. The direction of movement of all of the components through the transfer station is reversed in FIG. 4 relative to FIG. 2 and, therefore, the illuminated post-nip area is on the opposite side of the Figure in this case. Common exemplary elements are illustrated by prime numbers. Exemplary negative charge signs are illustrated schematically for toner particles 21 transferred from the imaging surface 20′ to the copy sheet 18′. Exemplary positive charge signs are illustrated schematically within the photoconductor belt 12′ to show their conduction through the belt in the nip and post-nip areas which are flooded by the lamp 41′. As in FIG. 2, the lamp 41′ and its confining light shield 42′ extend uniformly transverse the width of the belt 12′.

It may be seen that FIG. 4 differs from FIG. 2 in that the bias electrode providing the transfer field is here provided by a single transparent fixed electrode 51 slidably engaging the backside of the belt 12′. The transfer bias voltage is, however, applied similarly to a transparent conductive coating 52 against the back of the belt, and the lamp 41 similarly shines through the transfer electrode into the belt 12′, and is shielded from illuminating the pre-nip area by the shield 42′.

It will be appreciated that all of the polarities illustrated are exemplary and that opposite polarity systems can be provided conventionally for all of the embodiments herein. It will also be appreciated that the components can be reversed in position, i.e., the transfer electrode could engage the top surface of the belt while the imaging surface and the copy sheet could engage the under surface of the belt. Further, the electrical bias connections could be reversed, i.e., the transfer electrode could be grounded or oppositely biased relative to the imaging surface substrate.

Still referring to FIG. 4, there is additionally disclosed an improved electrostatic belt paper tacking system utilizing the same relatively thick photoconductive transport belt and appropriate separate charging and illumination thereof. In FIG. 4, an exemplary sheet tacking station is shown upstream of the transfer station at the right hand side of the Figure. A conventional D.C. corona generator 100 applies negative charges to the copy sheet 18′ so as to electrostatically tack the copy sheet to the belt 12′. (A biased roller could also be used). This system is in lieu of the electrostatic sheet tacking system of FIG. 1 previously described, and will work with other types of transfer systems, although particularly suited to the transfer system disclosed herein. It differs from the cited prior art electrostatic sheet tacking systems in that simultaneously with the application of negative charges by the coroton 100 there is provided at the opposing side of the belt 12′ a grounded transparent electrode 101, and the rear side of the belt 12′ is simultaneously illuminated by a lamp 102 within the electrostatic field region of the belt which is between the charges placed by the corona generator 100 and the grounded electrode 101. The electrode 101 can be similar to the previously described electrode 51. This system achieves the precharging of the copy sheet negatively and the belt positively (by induction) prior to transfer. With the cited prior art systems the charge on the paper 18′ by the corona generator can slightly increase the instability of transferred negative toner images 21. In this disclosed system this undesirable affect is counteracted by causing the positive counter charges in the belt to be placed as closely as possible to the negative paper charges. This is accomplished by the exposure of the belt 12′ to light simultaneously with the charging of the paper 18′. This provides conductivity for the belt as it is being charged, which allows the charge to relax (conduct) through the belt to the paper-belt interface and to become equal and opposite to the paper charge. Thus, a good electrostatic paper tacking field is provided for retaining the paper on the belt 12 throughout the entire system. Yet, because these paper holding charges are equal and closely spaced from one another, they do not generate external fields significantly affecting the pretransfer air gap fields. Any external fields the paper tacking charges provide are insignificant in comparison to the transfer fields provided between the transfer electrode and the imaging surface substrate. Thus, toner stability is not affected.

It will be noted that the belt 12′ is not illuminated except as in the specified illumination areas. Thus, paper retaining or tacking charges placed by the corona generator 100, or other suitable charging means, in the photoconductor belt 12 tend to remain trapped therein until subsequent illumination. It will also be noted that the above-described sheet tacking system provides electrostatic tacking forces which are effectively independent of the physical thickness of the belt 12′, since the opposite polarity attractive charges are formed at the interface of the copy carrying side of the belt only.

Referring now to FIG. 3, there is shown a quite different embodiment. In FIG. 3 there is no photoconductive transport belt 12 or 12′. Rather, the configuration is similar to that of the transfer station of a more conventional bias roll transfer system as disclosed in the previously cited references on this subject. Here the relatively thick photoconductive layer is provided as the outer layer of a cylindrical bias transfer roller 100 which is electrically biased at an internal conductive core 112. The internal conductive core 112 here is a transparent electrode, and a fixed lamp 114 and light shield 116 are inside this core. They function similarly to the lamp 41 and light shield 42 of the embodiment of FIG. 2. However, the illumination is out through the biased conductive core 112 into the overlying thick layer of photoconductive material of the roller 110 itself. The roller 110 forms a direct transfer nip contact with the conventional imaging surface 20″, which nip the copy sheet 18″ passes for image transfer. Only the nip and post-nip areas of the photoconductive roller body 110 are illuminated. Thus, as illustrated, the transfer bias is conducted out to the outer surface of the roller 110 only in these areas. This provides tailored transfer fields, since in the pre-nip area the transfer bias is separated by the full thickness of the roller 110 photoconductive layer.

Illumination from behind and through the imaging surface 20, 20′ or 20″ could be provided in the nip and post-nip areas of any of the disclosed embodiments. However, such light would not affect the transfer fields unless that it also penetrated the copy sheet 18, 18′ or 18″ and also the belt 12 or 12′, (or the roller 110). This would require a transparent substrate for the imaging surface layer, a transparent imaging surface layer and sufficiently translucent copy sheets and photoconductive belts or rollers. Such light would also be obstructed in the toner image areas. Thus, such an arrangement would have substantial disadvantages and limitations as compared to the previously disclosed arrangements. Such illumination might, however, be additionally provided merely for improved toner release from the imaging surface.

The transfer system disclosed herein is presently considered to be preferred; however, it is contemplated that further variations and modifications within the purview of those skilled in the art can be made therein. The following claims are intended to cover all such variations and modifications as fall within the true spirit and scope of the invention.

What is claimed is:

1. In an electrostatographic copying system in which an image is formed on an imaging surface and electrostatically transferred at a transfer station to a copy surface, the improvement comprising:

a copy transport belt having a copy supporting surface and an opposite surface, said belt comprising a photoconductive layer;

means for moving said copy supporting surface of said belt into and out of engagement with said imaging surface at said transfer station to from pre-nip, nip, and post-nip areas therewith, respectively;

electrically biased transfer electrode means for applying an image transfer field to said imaging surface through said photoconductive layer of said belt at said transfer station in said pre-nip, nip and post-nip areas; and illumination means for illuminating only said nip and post-nip areas of said photoconductive layer and rendering them conductive for tailoring said image transfer field for a relatively lower pre-nip transfer field than post-nip transfer field.

2. The copying system of claim 1 wherein said electrically biased transfer electrode means engages said opposite side of said belt, opposite from said imaging surface, and comprises an electrically biased light transmitting conductor, and wherein said illumination means illuminates said opposite surface of said belt through said light transmitting conductor.

3. In an electrostatographic copying system in which an image is formed of an imaging surface and electrostatically transferred at a transfer station to a copy sheet, the improvement comprising:

a copy transport belt having a copy sheet supporting side and an opposite side, said belt consisting essentially of a photoconductive layer of a thickness substantially greater than said copy sheet;

means for moving said copy sheet supporting side of said belt into and out of engagement with said imaging surface at said transfer station to form pre-nip, nip, and post-nip areas therewith, respectively, electrically biased transfer electrode means for applying an image transfer field to said imaging surface through said photoconductive layer at said transfer station in said pre-nip, nip, and post-nip areas from said opposite side of said belt; and illumination means for illuminating only said nip and post-nip areas of said photoconductive layer and rendering them conductive, from said opposite side of said belt, for tailoring said image transfer field for a relatively lower pre-nip transfer field than post-nip transfer field.

4. The copying system of claim 3, wherein said electrically biased transfer electrode means is light transmitting and said illumination shines through said electrode means into said opposite side of said belt.

5. The copying system of claim 3, wherein said electrically biased transfer electrode means comprises a cylindrical roller rolling against said opposite side of said belt opposite from said nip engagement of said imaging surface with said copy sheet supporting side of said belt, said roller having a continuous conductive layer which is uniformly electrically biased.

6. The copying system of claim 5, wherein said roller is light transmitting and said illumination means comprises a light source inside of said roller shining into said opposite side of said belt, which light source is shielded from illumination of said pre-nip area of said photoconductive layer.

7. The copying system of claim 4, wherein said electrically biased transfer electrode means comprises a fixed conductor slidably engaging said opposite side of said belt.

8. The copying system of claim 3, further including a copy sheet tacking station, for tacking said copy sheet to said copy transport belt prior to and spaced from said transfer station, comprising charging means for charging said copy sheet and second illumination means for simultaneously illuminating said photoconductive layer of said belt while said charging means is charging said copy sheet.

9. The copying system of claim 8, further including light transmitting conductive electrode means at said copy sheet tacking station positioned at said opposite side of said belt; and wherein said second illumination means illuminates said opposite side of said belt through said conductive electrode means, so that said photoconductive layer conducts sheet tacking charges to said copy sheet supporting side of said belt.

10. In an electrostatographic copying system in which an image is formed on an imaging surface and electrostatically transferred at a transfer station to a copy, the improvement comprising:

an image transfer roller, said roller comprising a conductive core and a thick photoconductive layer overlying said conductive core, said roller rollably opposing said imaging surface at said transfer station to form pre-nip, nip, and post-nip areas therewith for passage of said copy therebetween;

electrical transfer bias means connected to said conductive core for applying an image transfer field to said imaging surface through said photoconductive layer at said transfer station in said pre-nip, nip, and post-nip areas; and illumination means for illuminating only said nip and post-nip areas of said photoconductive layer and rendering them conductive for tailoring said image transfer field for a relatively lower pre-nip transfer field than post-nip transfer field.

11. The copying system of claim 10, wherein said illumination means comprises a partially shielded flooding light source inside of said roller and wherein said conductive core is light transmitting.

12. In an electrostatographic copying method in which an image is formed on an imaging surface and electrostatically transferred to a copy substrate moved through a transfer station, wherein said copy substrate is moved into and out of engagement with said imaging surface to form pre-nip, nip, and post-nip areas therewith, the improvement comprising the steps of:

moving a photoconductive material layer through said pre-nip, nip, and post-nip areas of said transfer station with said copy substrate;

applying an electrostatic image transfer field to said imaging surface and said copy substrate through said photoconductive material layer at said transfer station in said pre-nip, nip, and post-nip areas; and illuminating only the areas of said photoconductive material layer in said nip and post-nip areas to render only those areas conductive for tailoring said image transfer field for a relatively lower pre-nip transfer field than post-nip transfer field.

13. The copying method of claim 12, wherein said photoconductive material layer is moved in a continuous endless path with one side thereof facing said imaging surface and an opposite side thereof subjected to said illuminating.

14. The copying method of claim 12, wherein said photoconductive material layer is carried by an endless belt and wherein said copy substrate is a copy sheet, and wherein said copy sheet is electrostatically carried on one side of said endless belt through said transfer station.

15. The copying method of claim 14, wherein said image transfer field is applied by applying an electrically biased electrode against the side of said belt opposite from the side carrying said copy sheet in said transfer station.

16. The copying method of claim 15, wherein said electrically biased electrode is light transmitting and wherein said illuminating is provided by flooding light through said electrically biased electrode into the side of said belt opposite from the side carrying said copy sheet.

17. The method of claim 14, further including the steps of charging said copy sheet while said copy sheet is on said belt, but prior to said transfer station, and while simultaneously illuminating said photoconductive material layer, to tack said copy sheet to said belt electrostatically.

* * * * *